US009175540B2

(12) United States Patent
Voss et al.

(10) Patent No.: US 9,175,540 B2
(45) Date of Patent: Nov. 3, 2015

(54) CONTROL SYSTEM FOR A SUBSEA WELL

(75) Inventors: Robert Karl Voss, Houston, TX (US); William Munro, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 368 days.

(21) Appl. No.: 13/605,556

(22) Filed: Sep. 6, 2012

(65) Prior Publication Data

US 2014/0060850 A1 Mar. 6, 2014

(30) Foreign Application Priority Data

Sep. 6, 2011 (EP) ..... 11180155.1

(51) Int. Cl.
*E21B 7/12* (2006.01)
*E21B 33/035* (2006.01)

(52) U.S. Cl.
CPC ..... *E21B 33/0355* (2013.01)

(58) Field of Classification Search
CPC .... E21B 33/035; E21B 33/0355; E21B 34/04
USPC ..... 166/344, 347, 363, 373
See application file for complete search history.

(56) References Cited

U.S. PATENT DOCUMENTS

| | | | | |
|---|---|---|---|---|
| 3,411,576 | A | 11/1968 | Otis | |
| 3,827,486 | A * | 8/1974 | Hall | 166/359 |
| 4,154,298 | A | 5/1979 | Gano | |
| 4,223,736 | A * | 9/1980 | Foster, Jr. | 166/386 |
| 4,306,623 | A * | 12/1981 | Brooks | 166/322 |
| 4,378,850 | A * | 4/1983 | Barrington | 166/373 |
| 4,703,774 | A * | 11/1987 | Seehausen | 137/614.04 |
| 5,868,204 | A | 2/1999 | Pritchett et al. | |
| 6,854,704 | B1 * | 2/2005 | Young | 251/61.4 |
| 7,770,653 | B2 * | 8/2010 | Hill et al. | 166/379 |
| 8,297,359 | B2 * | 10/2012 | McKay et al. | 166/359 |
| 8,720,587 | B2 * | 5/2014 | Edwards | 166/373 |
| 8,794,334 | B2 * | 8/2014 | June | 166/368 |
| 2003/0150619 | A1 | 8/2003 | Meaders | |
| 2003/0150620 | A1 | 8/2003 | Deberry et al. | |
| 2011/0300008 | A1 * | 12/2011 | Fielder et al. | 417/410.3 |
| 2013/0098632 | A1 * | 4/2013 | Wetzel et al. | 166/373 |
| 2014/0124058 | A1 * | 5/2014 | Edwards | 137/456 |

FOREIGN PATENT DOCUMENTS

| | | |
|---|---|---|
| EP | 2236741 A2 | 10/2010 |
| GB | 2398592 A | 8/2004 |

(Continued)

OTHER PUBLICATIONS

Voss et al.: "Subsea Tree Installation, Lessons Learned on a West Africa Development", Offshore Technology Conference, May 5-8, 2003, XP007920097.

(Continued)

*Primary Examiner* — Matthew Buck
*Assistant Examiner* — Aaron Lembo
(74) *Attorney, Agent, or Firm* — GE Global Patent Operation

(57) ABSTRACT

A control system for a subsea well is provided. The control system comprises a tree comprising a hydraulic control supply line for use in opening a downhole safety valve as a result of hydraulic pressure in the line. A part of the line is carried by a structure which is subject to the pressure of a production fluid from the well used in the control system so that the line is separable in response to a failure of the integrity of the structure.

14 Claims, 3 Drawing Sheets

(56) References Cited

FOREIGN PATENT DOCUMENTS

| | | | |
|---|---|---|---|
| GB | 2426771 | A | 12/2006 |
| GB | 2454807 | A | 5/2009 |
| GB | 2479000 | A | 9/2011 |
| WO | 2006133350 | A2 | 12/2006 |
| WO | 2008034024 | A2 | 3/2008 |
| WO | 2008074995 | A1 | 6/2008 |

OTHER PUBLICATIONS

European Search Report dated Jan. 19, 2012 which was issued in connection with the EP Patent Application No. 11180155.1 which was filed on Sep. 6, 2011.

The Great Britain Search Report issued in connection with corresponding GB Patent Application No. 1215847.3 dated on Oct. 18, 2012.

* cited by examiner

CONTROL SYSTEM FOR A SUBSEA WELL

BACKGROUND OF THE INVENTION

Embodiments of the invention relate to a control system for a subsea well.

A control system for a subsea well, for example a hydrocarbon production well, generally comprises a subsea tree and a tubing hanger which carries production tubing. In the tubing, there is a downhole safety valve (DHSV), typically in the form of a so-called hydraulically operated surface controlled subsurface safety valve (SCSSV). When hydraulic pressure is applied via a control supply line, the DHSV opens against the action of a spring or production fluid pressure. In the event of a failure in the control system, supply of fluid for opening the DHSV is stopped, resulting in closure of the DHSV under the action of the spring or production fluid pressure, to prevent the flow of production fluid from the well.

BRIEF DESCRIPTION OF THE INVENTION

According to an embodiment of the present invention, a control system for a subsea well is provided. The control system comprises a tree comprising a hydraulic control supply line for use in opening a downhole safety valve as a result of hydraulic pressure in the line, wherein a part of the line is carried by a structure which is subject to the pressure of a production fluid from the well used in the control system so that the line is separable in response to a failure of the integrity of the structure.

According to an embodiment of the present invention, a method of providing a control system for a subsea well is provided. The method comprises providing a tree with a hydraulic control supply line for use in opening a downhole safety valve as a result of hydraulic pressure in the line; and carrying a part of the line by a structure which is subject to the pressure of a production fluid from the well such that the line is separable in response to a failure of the integrity of the structure.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

The following description of the exemplary embodiments refers to the accompanying drawings. The same reference numbers in different drawings identify the same or similar elements. The following detailed description does not limit the invention.

According to an embodiment of the present invention, a tree comprises a hydraulic control supply line for use in opening a downhole safety valve as a result of hydraulic pressure in the line, wherein a part of said line is carried by a production wing block attached to the tree so that the line is separable in response to a separation of the production wing block from the tree.

Figure 1:
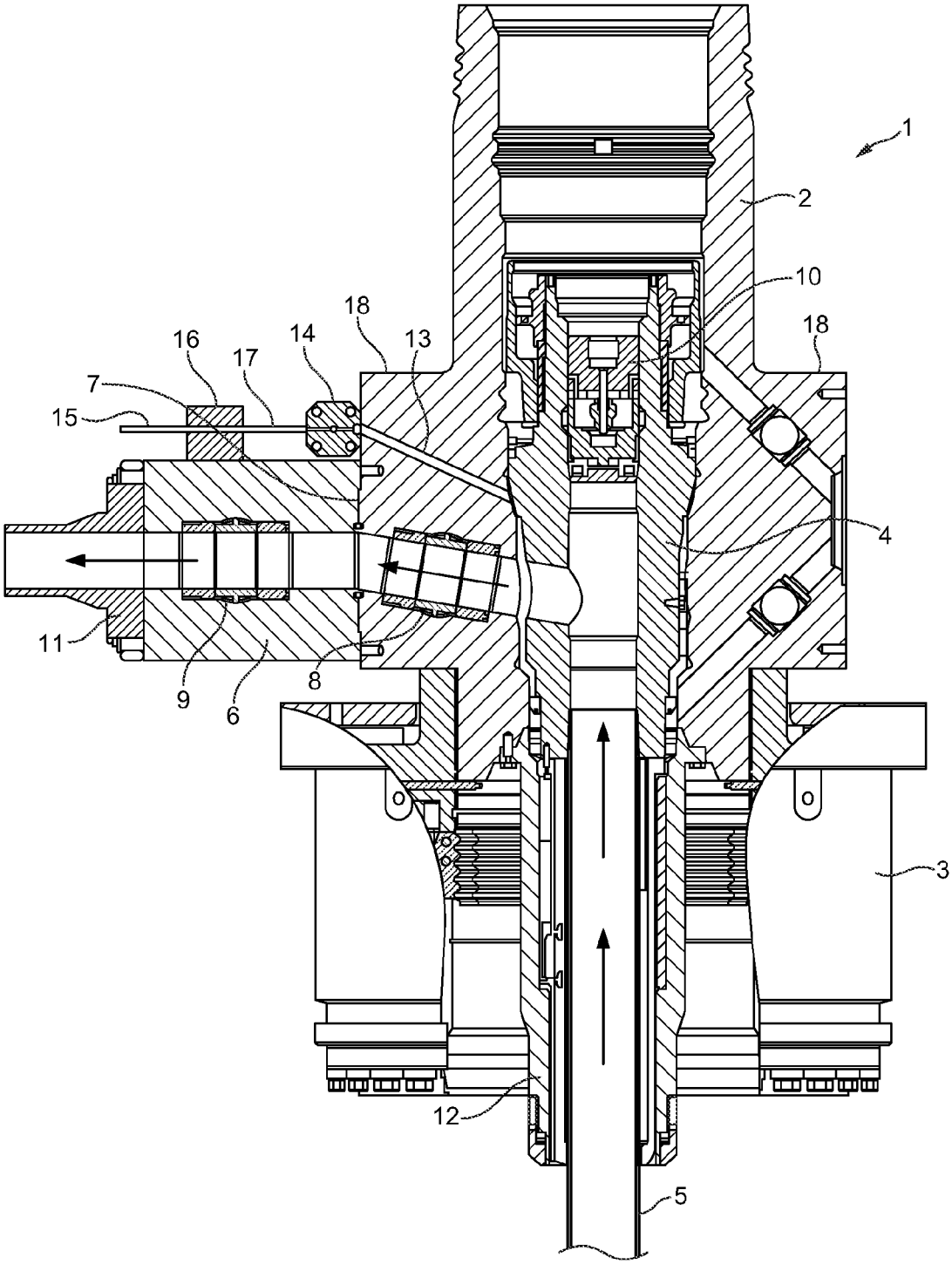
FIG. 1 is a vertical section through a part of a control system for a subsea hydrocarbon production well, incorporating an embodiment of the invention.
Figure 2:
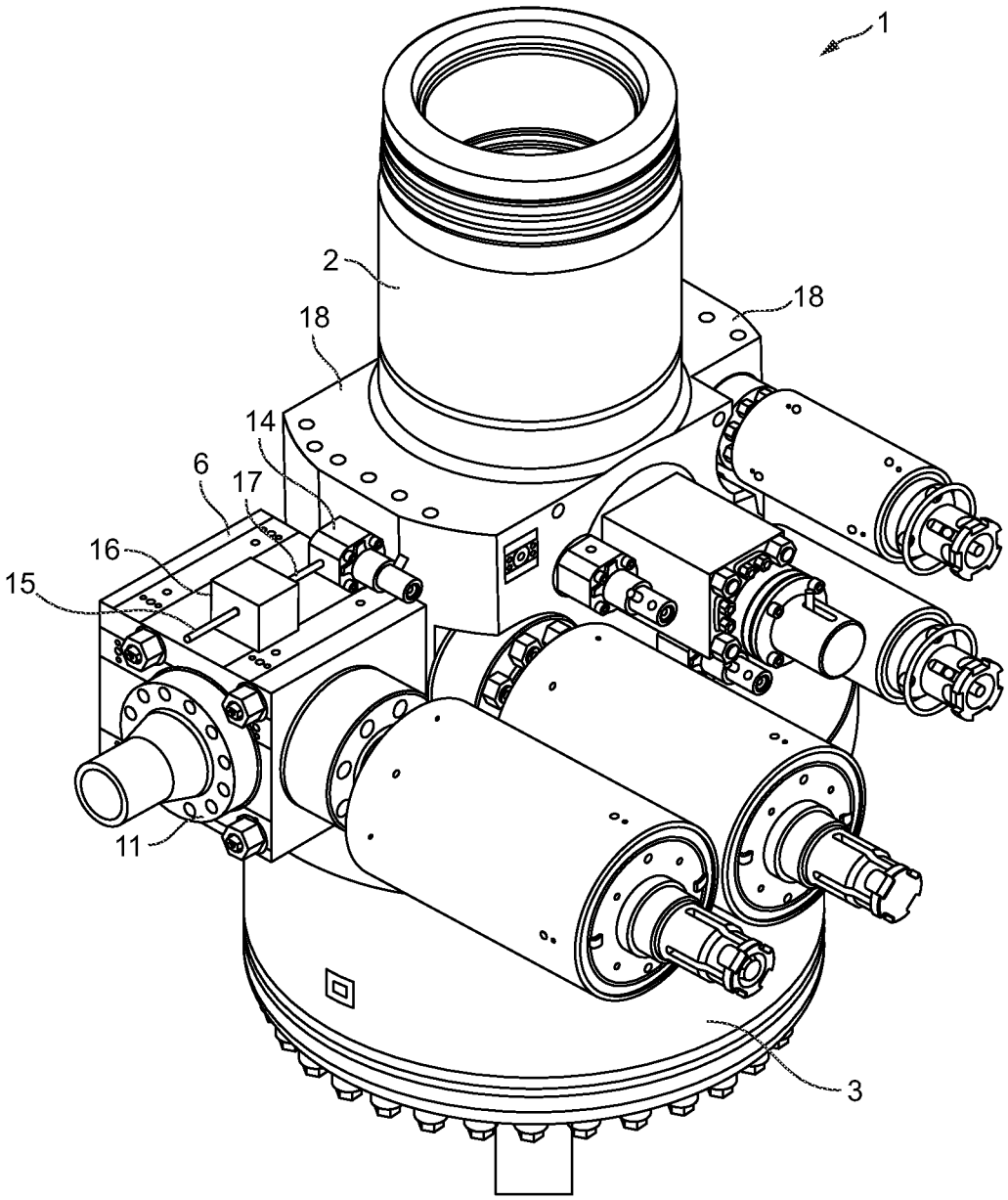
FIG. 2 is a perspective view of what is shown in FIG. 1.

FIGS. 1 and 2 depict a tree 1 at a wellhead, the tree comprising a tree head 2 and a tree connector 3; a tubing hanger 4 in the tree head 2, from which production tubing 5 is suspended; a production wing block (PWB) 6 of the tree, attached to the tree head 2 at an interface 7, the flow of production fluid from the well through the tubing 5 and PWB 6 being indicated by arrows; a production master valve 8 in the tree head 2, a production wing valve 9 in PWB 6; a crown plug 10 of the tree; and a connector 11 for connecting the PWB 6 to a production flowline.

The tree 1 is connected to the wellhead via tree connector 4, an annular sleeve 12 in the connector 3 engaging with a casing string of the well.

A DHSV is disposed in the production tubing 5 below the tree 1, hydraulic fluid for an actuator for opening the DHSV being supplied via a safety supply port 13 in the tree head 2 from an isolation valve 14 on the tree head 2 and a DHSV control supply line 15 coupled with valve 14 and clamped to PWB 6 by a clamp 16 on PWB 6. Isolation valve 14 can be opened or closed manually by a remotely operated vehicle or be hydraulically operated. Hydraulic fluid is supplied through line 15, valve 14 and port 13 under the control of a subsea control module at the tree. The port 13 extends down through the tubing hanger 4 (behind the plane of the section comprising FIG. 1), and then between the production tubing 5 and the well casing to the actuator of the DHSV. Between clamp 16 and isolation valve 14, the line 15 comprises a break-away portion 17.

The tree head 2 is provided with a tree cap (not shown) and a protective plate (not shown) is bolted to shoulders 18 of the tree head 2 to cover and protect items extending from the tree head 2, including PWB 6.

To keep the DHSV open and the well flowing, pressure must be maintained in the DHSV control supply line 15 and in port 13, and, in the event of pressure loss therein, the design of the actuator and the DHSV are such that the DHSV closes (under the action of a spring or production fluid pressure) to stem the flow of production fluid from the well. Consider the situation where the DHSV isolation valve 14 is in the normally open position and there is pressure in the line 15 but failure of the integrity of PWB 6 occurs because interface 7 between the PWB 6 and the tree head 2 is lost due to an overload of the connection between them by an externally applied force or internal pressure overload. Since the DHSV supply line 15 is clamped to the PWB 6, when failure of the PWB to tree head interface occurs, the break-away portion 17 will separate and fail, resulting in loss of line pressure and fail-safe closure of the DHSV. In its simplest form, portion 17 could be a piece of tubing in line 15 clamped on to the PWB 6 by clamp 16, which tubing breaks when the PWB 6 is pulled away from the tree head 2.

Figure 3:
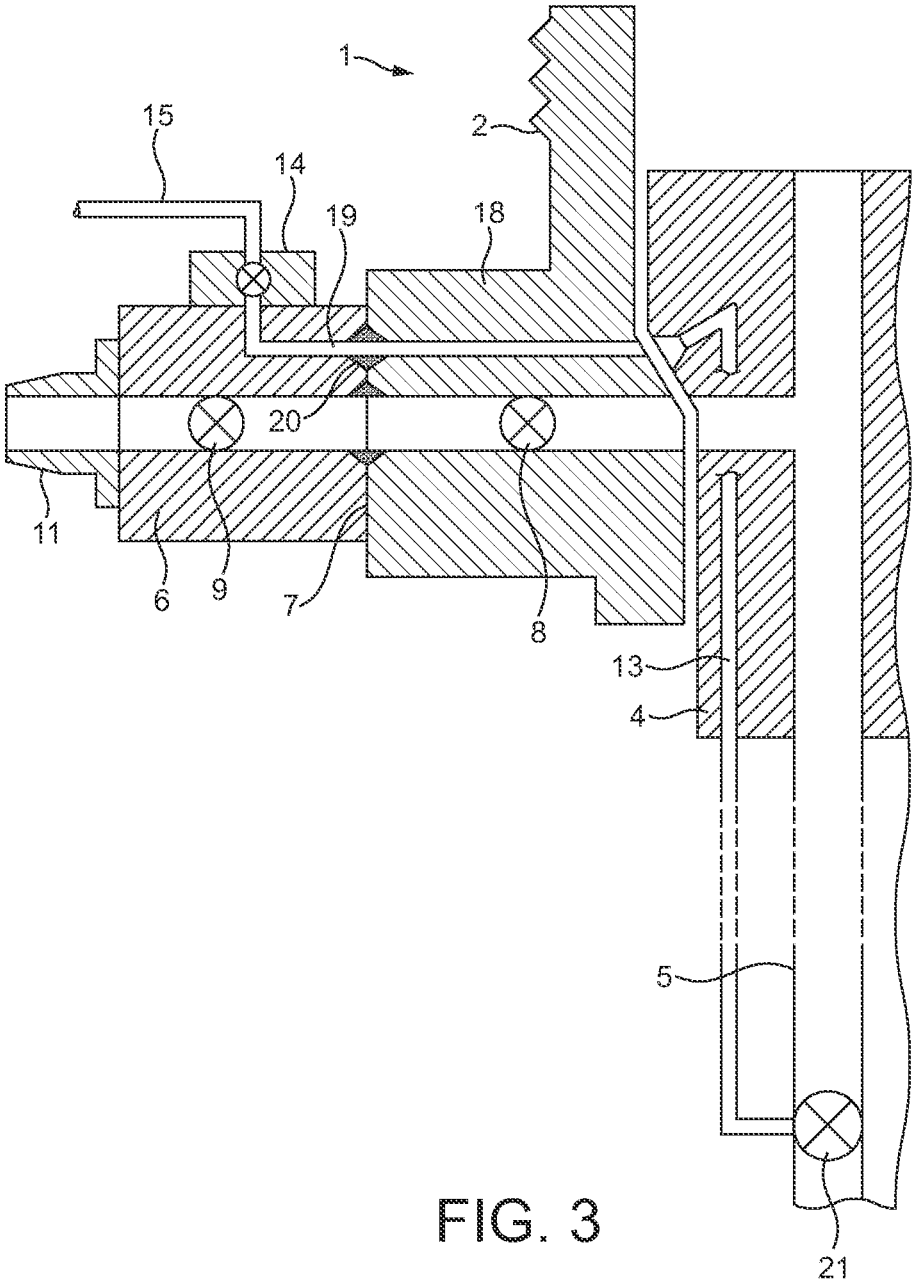
FIG. 3 is a schematic vertical section through another embodiment of the invention.

In FIG. 3, the isolation valve 14 is mounted on the PWB 6. A part 19 (provided by a bore in PWB 6) of the control line 15 passes from valve 14 through the body of PWB 6 and through a seal 20 between the PWB 6 and the tree head 2 to port 13 which extends down through tubing hanger 4 to the actuator of a DHSV 21. In this embodiment, in response to a failure of the integrity of PWB 6 because of separation of the PWB 6 from the tree head 2 and a failure of the PWB to tree head interface 7, the part 19 of line 15 will separate and vent fluid, to result in loss of line pressure and fail-safe closure of the DHSV 21.

In the above embodiments, some causes of failure of the PWB to tree head connection are objects dropped from vessels, snag loads applied via a flow spool connected to the PWB, or unexpected well conditions higher than design pressures, temperatures and corrosion and erosion allowances.

The structure may define part of the flowpath of production fluid from the well. In this case, said structure is part of the production fluid flow path downstream of the tree, such as a production wing block on the tree.

Said part of said control line could be attached to the structure by a clamp, typically said control line passing from said clamp to an isolation valve on the tree. In another example, said part of said control line passes through the structure to the tree, typically passing through the structure to the tree from an isolation valve on the structure. Although the embodiments relate to a so-called "horizontal tree" configuration, embodiments of the present invention are also applicable to a "vertical tree" configuration. Also, the control line 15 could be carried by a structure other than a production wing block. For example, in the embodiment of FIGS. 1 and 2, the clamp 16 could be disposed on connector 11 or on production flowline extending from it.

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A control system for a subsea well, the control system comprising:

a tree comprising a hydraulic control supply line for use in opening a downhole safety valve as a result of hydraulic pressure in the line;

a structure comprising a production wing block configured to carry part of the line, the line being mounted to an outer portion of the production wing block using a fastener, the line being directly connected to the tree, wherein the structure is part of the production fluid flow path downstream of the tree and defines part of a flow path of the production fluid from the well, and is subject to the pressure of a production fluid from the well used in the control system; wherein in response to a failure of the integrity of the structure, the line separates and vents fluid resulting in the closure of a downhole safety valve.

2. The control system according to claim 1, wherein the fastener comprises a clamp.

3. The control system according to claim 2, wherein the control line passes from the clamp to an isolation valve on the tree.

4. The control system according to claim 1, wherein the part of the control line passes through the structure to the tree.

5. The control system according to claim 4, wherein the control line passes through the structure to the tree from an isolation valve on the structure.

6. The control system of claim 1, wherein the part of the control line is attached to the production wing block by a clamp.

7. The control system of claim 6, wherein the control line passes from the clamp to an isolation valve on the tree.

8. The control system of claim 1, wherein the part of the control line passes through the production wing block to the tree.

9. The control system of claim 8, wherein the control line passes through the production wing block to the tree from an isolation valve on the wing block.

10. A method of controlling a subsea well, the method comprising:

providing a tree with a hydraulic control supply line for use in opening a downhole safety valve as a result of hydraulic pressure in the line; and carrying a part of the line by a structure comprising a production wing block, the line being mounted to an outer portion of the production wing block using a fastener, the line being directly connected to the tree, the production wing block being subject to the pressure of a production fluid from the well;

wherein in response to a failure of the integrity of the structure, the line separates and vents fluid resulting in the closure of a downhole safety valve.

11. The method according to claim 10, wherein the fastener comprises a clamp.

12. The method according to claim 11, wherein the control line passes from the clamp to an isolation valve on the tree.

13. The method according to claim 10, wherein the part of the control line passes through the structure to the tree.

14. The method according to claim 13, wherein the control line passes through the structure to the tree from an isolation valve on the structure.

* * * * *